US012722759B2

(12) United States Patent
Bais et al.

(10) Patent No.: US 12,722,759 B2
(45) Date of Patent: Sep. 1, 2026

(54) CONTROL SYSTEM FOR KITE INCLUDING QUICK RELEASE

(71) Applicant: ADVENTURE SPORTS INC., Miami, FL (US)

(72) Inventors: John Bais, Victoria (CA); Lars Moltrup, Paia, HI (US)

(73) Assignee: ADVENTURE SPORTS INC., Miami, FL (US)

( * ) Notice: Subject to any disclaimer, the term of this patent is extended or adjusted under 35 U.S.C. 154(b) by 601 days.

(21) Appl. No.: 18/117,783

(22) Filed: Mar. 6, 2023

(65) Prior Publication Data

US 2024/0083564 A1 Mar. 14, 2024

Related U.S. Application Data

(60) Provisional application No. 63/316,791, filed on Mar. 4, 2022.

(51) Int. Cl.
*B63H 8/18* (2020.01)

(52) U.S. Cl.
CPC ..... *B63H 8/18* (2020.02)

(58) Field of Classification Search
CPC ..... B63H 8/18; B63H 8/16; B63B 21/08
See application file for complete search history.

(56) References Cited

U.S. PATENT DOCUMENTS

| | | | | |
|---|---|---|---|---|
| 1,804,927 | A | 5/1931 | Gilbert | |
| 1,878,373 | A | 9/1932 | Breeser | |
| 2,954,236 | A | 9/1960 | Osborn | |
| 4,040,137 | A | 8/1977 | Fetherston et al. | |
| 4,255,369 | A | 3/1981 | Napier | |
| 4,316,618 | A | 2/1982 | Sampson | |
| 5,370,432 | A | 12/1994 | Kram | |
| 5,673,927 | A | 10/1997 | Vermillion | |
| 5,799,957 | A | 9/1998 | Okajima et al. | |
| 6,035,799 | A | 3/2000 | Lukanovich et al. | |
| 6,461,210 | B2 | 10/2002 | Lorenzo | |
| 6,523,851 | B1 | 2/2003 | Maravetz | |
| 6,558,217 | B1 | 5/2003 | Jones | |
| 6,691,954 | B1 * | 2/2004 | Harrington | B63H 8/16 244/155 A |
| 8,419,043 | B2 | 4/2013 | Fournier | |
| 9,415,846 | B2 | 8/2016 | Shupe et al. | |
| 9,566,729 | B2 | 2/2017 | Longo et al. | |
| 9,776,065 | B2 | 10/2017 | Bjertnaes | |
| D885,496 | S | 5/2020 | Xianxin | |
| 10,843,777 | B2 | 11/2020 | McLean | |

(Continued)

FOREIGN PATENT DOCUMENTS

| | | |
|---|---|---|
| CN | 211226019 | 8/2020 |
| DE | 3603258 | 10/1987 |

(Continued)

*Primary Examiner* — Andrew Polay
(74) *Attorney, Agent, or Firm* — Malloy & Malloy, P.L.; W. John Eagan

(57) ABSTRACT

A control system for a kite having a quick release loop assembly includes a retention mechanism configured to release one end of the loop upon sliding a handle from a covered disposition to an uncovered disposition. The quick release assembly also includes a mechanism to untwist a landing line tube from a static line automatically, and to automatically index a landing line.

1 Claim, 13 Drawing Sheets

(56) References Cited

U.S. PATENT DOCUMENTS

| | | | | |
|---|---|---|---|---|
| 11,505,290 | B2 | 11/2022 | Rohrer | |
| 11,787,512 | B2 | 10/2023 | Bernsen | |
| 2006/0119055 | A1 | 6/2006 | Heidlebaugh | |
| 2006/0292944 | A1 | 12/2006 | Cumrine | |
| 2008/0203703 | A1 | 8/2008 | Hauglin et al. | |
| 2009/0230658 | A1 | 9/2009 | Fournier | |
| 2012/0025490 | A1 | 2/2012 | Van Bregmann, Jr. | |
| 2013/0048791 | A1 | 2/2013 | Hastilow et al. | |
| 2014/0017937 | A1* | 1/2014 | Holliday | H01R 24/38 439/585 |
| 2015/0014962 | A1 | 1/2015 | Rayner | |
| 2015/0104987 | A1 | 4/2015 | Shupe et al. | |
| 2015/0291265 | A1 | 10/2015 | Longo et al. | |
| 2020/0358220 | A1* | 11/2020 | Meyer | H01R 13/58 |
| 2021/0253208 | A1 | 8/2021 | Roger | |
| 2022/0219947 | A1* | 7/2022 | Przeciechowski | B66C 1/26 |
| 2022/0363350 | A1 | 11/2022 | Bernsen | |
| 2024/0034246 | A1 | 2/2024 | Aggarwal et al. | |
| 2025/0066003 | A1* | 2/2025 | Dombois | B63H 8/18 |

FOREIGN PATENT DOCUMENTS

| | | |
|---|---|---|
| DE | 202011050423 | 11/2011 |
| DE | 102017122966 | 4/2019 |
| DE | 202019102639 | 5/2019 |
| DE | 202019003534 | 10/2019 |
| EP | 0188170 | 7/1986 |
| EP | 346509 | 12/1989 |
| EP | 4071045 | 10/2022 |
| FR | 2791901 | 10/2000 |
| KR | 20190131811 | 11/2019 |
| WO | WO2012177783 | 12/2012 |
| WO | WO2018138052 | 8/2018 |
| WO | WO2023168120 | 9/2023 |

* cited by examiner

CONTROL SYSTEM FOR KITE INCLUDING QUICK RELEASE

CROSS REFERENCE TO RELATED APPLICATIONS

This application claims benefit to a U.S. Provisional Patent Application having Ser. No. 63/316,791 filed on Mar. 4, 2022. The above application is incorporated by reference herein in its entirety.

BACKGROUND OF THE INVENTION

Field of the Invention

The present invention is directed to control systems for kites used in water and wind sports, which are sometimes known as control bars, and which typically include a quick release loop that secures a rider, via a harness, to the kite.

Description of the Related Art

The present invention solves many problems existing in the art. As an initial matter, the present invention provides a control system including quick release loop for a water sports harness where the forces transmitted through the loop are decoupled from the handle that activates the quick release mechanism. Many common configurations in the industry result in the handle being coupled to the tensile forces that are transmitted from the kite to the harness via the loop. This can present several issues, such as changing the release force, as it can increase or decrease depending on how much force is being transmitted through the quick release. This leads to unreliable activation. Additionally, the constant loading of the handle can cause it to creep over time, which introduces play into the mechanism and can lead to the handle becoming stuck in partially released positions. Therefore, there is a need in the art for a quick release loop assembly that decouples the release handle from the forces transmitted through the loop. There is also a need in the art for a quick release loop that facilitates the untwisting of kite lines after a rotation, but prevents rotation of the loop when the user is not hooked into the harness. This keeps the loop in the same orientation when the user is unhooked so that the user does not have to check or adjust the orientation of the loop before hooking back in.

Many quick release loops also offer the user the ability to change loop sizes or styles to accommodate different riding styles or disciplines. However, because only one end of the loop is incorporated into the quick release mechanism, the second end is typically considered to be static. Therefore, many manufacturers have secured the second end of the loop in a fashion that is difficult to release and even may require tools. It is desired in the art to provide a quick release assembly that permits the second, static, end of the loop to be released easily and efficiently, without the use of tools, which will allow users to switch loops on the fly.

Yet another problem that the present invention seeks to resolve is the twisting of the landing line relative to the user or the kite. Twisting the landing line causes it to contract and can introduce a turn in the kite as the single line becomes shorter. Twisting can also inhibit release if it causes an obstruction within the mechanism. Therefore, it is desired in the art to provide a quick release assembly that is capable of indexing the landing line with the kite and user to avoid introducing twists into the landing line.

Yet another problem with currently available control systems is that from time to time the landing line tube will require servicing or disassembly but there are not readily available solutions that allow the landing line tube to be installed in a manner that permits non-destructive disassembly. The present invention meets these and other needs existing in the art.

SUMMARY OF THE INVENTION

The invention is directed to a water sports control system having a quick release loop assembly. The invention includes a quick release loop assembly, sometimes referred to as a "quick loop" which includes a loop that a user hooks into a harness. The quick loop is also attached to a plurality of lines that are rigged to a kite. Power from the kite is transferred through the quick loop to the user and provides propulsion. The control system also includes a control bar structured to translate along the lines that run between the user and the kite. Two control lines extending from the ends of the control bar allow the user to adjust the power developed by the kite, as well as steer the kite, by manipulating the control bar.

Focusing more specifically on the quick release loop assembly, it preferably includes a housing which houses a quick release mechanism and which also includes a handle or slide for activating the quick release mechanism. When activated, at least one end of a loop is released from the quick release loop assembly, thereby freeing the user, who is typically attached to the assembly via a hook extending from a harness that receives the loop.

At the other end of the quick loop is a receptacle that receives a plurality of lines or tubes from the kite, which can include a static line for transferring forces from the kite to the user, and in other embodiments can also include a landing line tube, which will be discussed in further detail below. However, in a most preferred embodiment, the handle or slide is decoupled from the forces that are transmitted between the static line and the loop. By way of example, the loop can include retention members on its ends which are configured to be inserted into a retention mechanism within the quick loop. The retention mechanism can include a pawl and ledge. In such a configuration the weight of the user is transmitted through the loop and onto the ledge. A common design for a release mechanism might involve the release of the ledge itself. However, this would not decouple the slide from the forces that are transmitted to the ledge. Therefore, in a most preferred embodiment, the release handle or slide activates a mechanism which instead permits the retention member to slide off of the ledge and out of the housing.

By way of further example, the retention mechanism can include a pivot pawl, which is biased by a torsion spring to rest obliquely against the corner of the ledge. A distal end of the pivot pawl extends from the ledge forming a recess between the pawl and the ledge. Additionally, the pivot pawl is dimensioned and configured to rotate about a point that is offset from, and inboard of, the recess itself. Therefore, when the loop is inserted into the retention mechanism, it will apply force on the pawl at a point that is offset from the pivot point of the pawl, and in a direction that is substantially perpendicular to the moment arm. Accordingly, the pivot pawl will rotate away from the ledge, allowing the retention member to pass through. Once beyond the ledge, the pivot pawl is then free to rotate back into position, trapping the retention member against the ledge in a retention recess. As may be readily understood, insertion of the loop into the retention mechanism requires relatively little force. However, withdrawal of the loop is substantially prevented. The retention member is dimensioned and configured to rest against the ledge (once inserted into the retention mechanism) and the vast majority of force applied to the loop will be transmitted into the ledge. In a most preferred embodiment, the pivot pawl rests against the side of the retention member in order to keep it on the ledge, however, the pawl, ledge, and retention member are dimensioned and configured such that the point at which the retention member pushes against the pawl is substantially in line with the pivot point of the pawl. In one embodiment, the distal end of the pawl includes a heel to accommodate the retention member in the appropriate orientation within the retention recess. Therefore, no moment can be created, and the pivot pawl will not be influenced to lift by the retention member. If the user desires to withdraw the loop from the retention mechanism, the user must first rotate the pawl out of the way and allow the retention member to slide off of the ledge.

In order to create an easily accessible quick release mechanism out of the foregoing arrangement, a handle can be provided on the housing which is configured to lift the pawl when activated by the user. In a most preferred embodiment, a portion of the housing, for example the upper portion, is configured to slide along a central shaft of the housing. The slide can then be configured to lift the pawl when urged away from the user. In a most preferred embodiment, a line is strung between a proximal end of the pawl and an opposite side of the housing. When the slide is pushed far enough to make the line taught, the line will pull on the proximal end of the pawl, the pawl will be lifted, and the loop will come free. In either event, the slide is decoupled from the forces transmitted through the loop, which are mainly directed into the ledge. Instead, the only force the user need overcome is the spring force biasing the pawl in a closed configuration.

In a preferred embodiment, the retention mechanism can be used to retain the second, static, end of the loop, in order to provide an efficient and "tool-less" release mechanism for the second end of the loop. In a most preferred embodiment, the slide is configured to be disposed between a covered orientation, in which the slide meets the base of the housing and fully covers the retention mechanism, and an uncovered orientation, in which the retention mechanism is exposed, or at least the distal end of the pawl is exposed. In an uncovered orientation, the pawl can be manually lifted to release the second end, facilitating a "tool-less" release and change of the loop. In one embodiment, the distal end of the pawl can include a tab protruding therefrom which is dimensioned and configured to be engaged by a finger of a user.

In another embodiment, the control system includes an automatic swiveling feature that untwists the landing line tube and the static line. In such an embodiment, the receptacle that receives the landing line tube and static line is free to rotate relative to the housing and loop. Therefore, the receptacle is capable of indexing the landing line tube and static line with the kite itself, and relative to the loop. Such a feature can provide convenience and safety to those who practice unhooked maneuvers, such as aerial twists and rolls.

More specifically, when a user performs an unhooked roll, the user retains control of the control bar, and the roll will cause the control bar to rotate relative to the lines. This will cause the landing line tube and static line to twist around one another. Multiple successive rolls can compound the issue. However, it is desirable for the loop to index with the control bar, so that when the user is ready to re-hook, the loop is in the same orientation as when the user first unhooked. This avoids the need for the user to visual confirm and/or manipulate the loop before re-hooking. As such, it can be seen that the loop should index with the control bar when unloaded, but the lines and tube should be free to rotate relative to the control bar when loaded, so that the lines can be untwisted.

In a most preferred embodiment, the quick loop assembly includes a central shaft that is free to rotate within the housing. A biasing element, such as a spring washer, biases the shaft against the receptacle so that friction forces cause the entire unit to rotate as one, however, when the loop is loaded, and the biasing element compresses, the receptacle, housing, and loop become free to rotate relative to the central shaft. This behavior benefits a user during a maneuver as follows: A user first unhooks in preparation for a maneuver. The biasing element forces the receptacle against the shaft so that the entire quick release assembly will rotate as a single unit. The user performs a maneuver, such as a roll, in which the static line and power line tubes become twisted about one another. Because the entire quick release assembly rotated as one unit, the loop is maintained in the position that the user expects, which helps the user to quickly and efficiently re-hook. Once the loop is loaded again, the receptacle separates from the shaft and the receptacle is free to rotate relative to the loop. Therefore, the landing line tube and static line are free to untwist. Optionally, the control bar includes separate indexed chambers, including a static line chamber and landing line tube chamber, separated by a wall. When the user pulls back on the control bar, the separate chambers will tend to straighten out the lines as it rides along the lines.

Another feature of the present invention is an indexable landing line assembly. That is, the landing line indexes with the assembly, rather than being allowed to rotate inside the assembly. In a preferred embodiment, the landing line runs through the central shaft of the quick release assembly and is attached to a stopper at the bottom of the assembly. The stopper mates against a collar at the bottom of the shaft, and a ring floats between the stopper and collar. Each of the stopper and collar include interlocking teeth on their interface surfaces. Accordingly, if the quick release assembly is rotated, the teeth on the collar will engage the teeth on the stopper, and the stopper will index the landing line in sync with the assembly.

Yet another feature of the present assembly is an assembly by which the landing line tube can be non-destructively removed from the trim cleat in order to facilitate service or replacement. The trim cleat includes a cup having a substantially funnel or wedge-shaped configuration on its interior surface. The landing line tube is installed within the cup and a barbed insert is inserted into the top of the landing line tube. Once force is applied to the landing line tube, the barbed insert and cup act to wedge the landing line tube in place, much like a morse taper. As such, a secure fitment of the landing line tube is achieved within the trim cleat without the use of adhesives or other permanent fixtures.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 17 is a section view taken along line C-C of FIG. 16.

Like reference numerals refer to like parts throughout the several views of the drawings.

DETAILED DESCRIPTION OF THE PREFERRED EMBODIMENT

Figure 1:
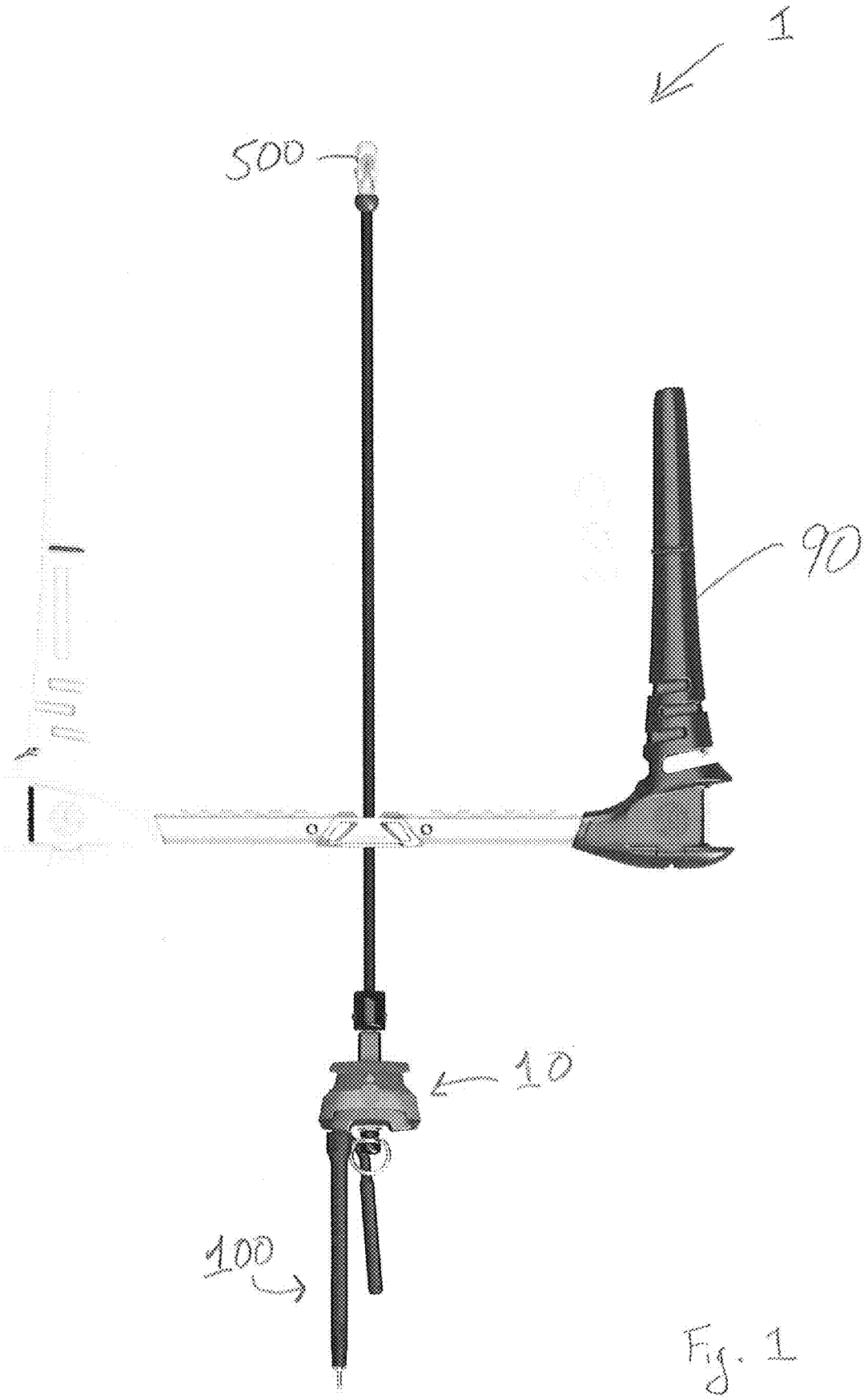
FIG. 1 is a front view of a control system including a quick release assembly according to one embodiment of the present invention.
Figure 2:
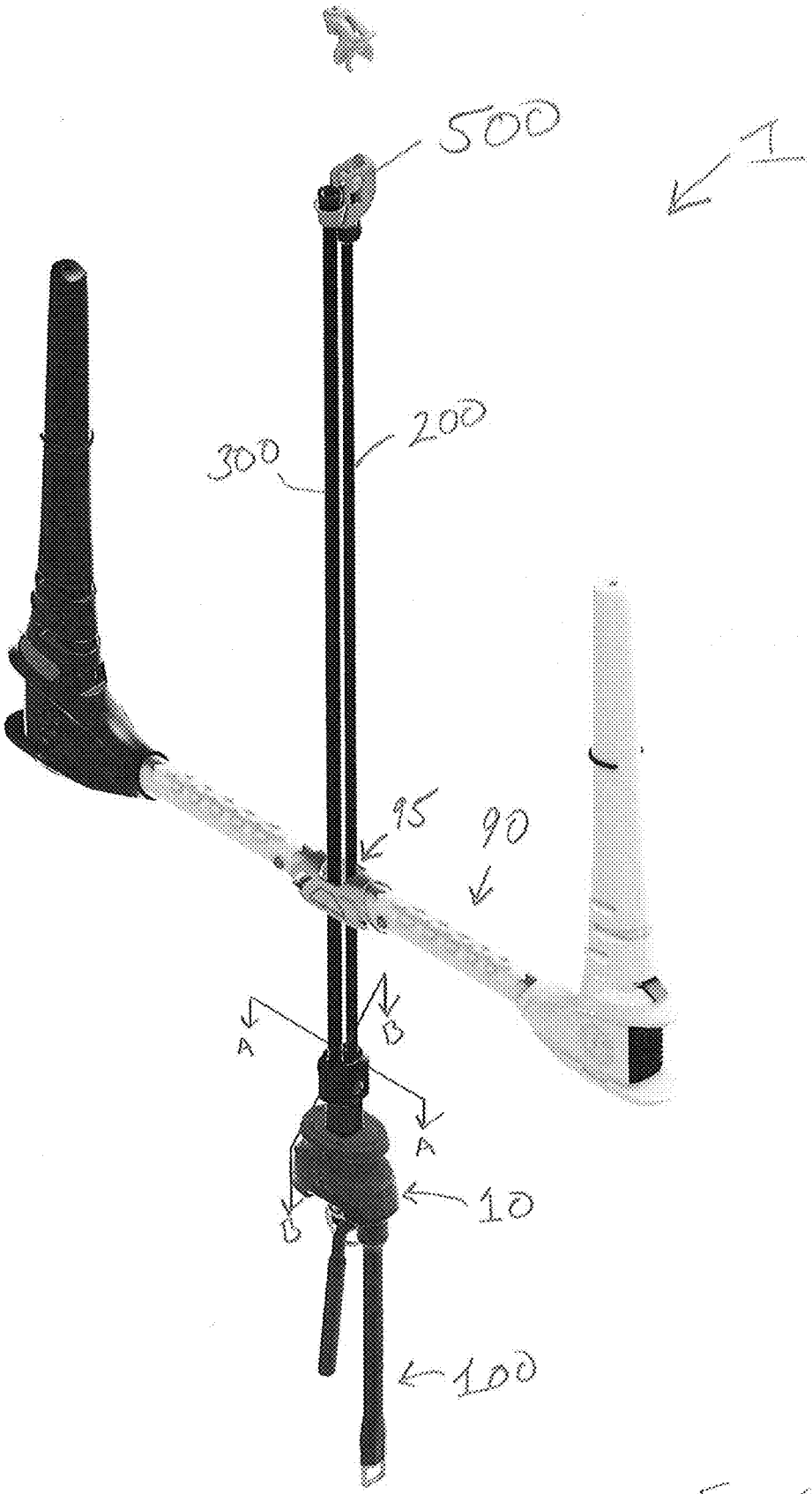
FIG. 2 is a perspective view of a control system including a quick release assembly according to the embodiment of FIG. 1.

One embodiment of a control system 1 according to the present invention is depicted in FIGS. 1 and 2. The control system 1 includes a control bar 90 which a user manipulates to adjust his or her speed and direction. The control bar 90 is connected to two control lines (not depicted) at its extreme ends and is also configured to slide along the length of a static line 200 and a landing line tube 300. The static line 200 primarily transmits force from a kite (or other power source) to the user via the quick release loop assembly 10 (sometimes referred to as a "quick loop"). The landing line tube 300 houses a landing line (not depicted) that normally does not transmit any force, unless the user activates the quick release mechanism, at which point the landing line acts to depower the kite. At the top of the system 1, a trim cleat 500 allows a user to adjust the trim of the kite, and acts as a conduit to transmit power from the kite to the static line 200. The trim cleat 500 also supports the landing line tube 300.

Figure 4:
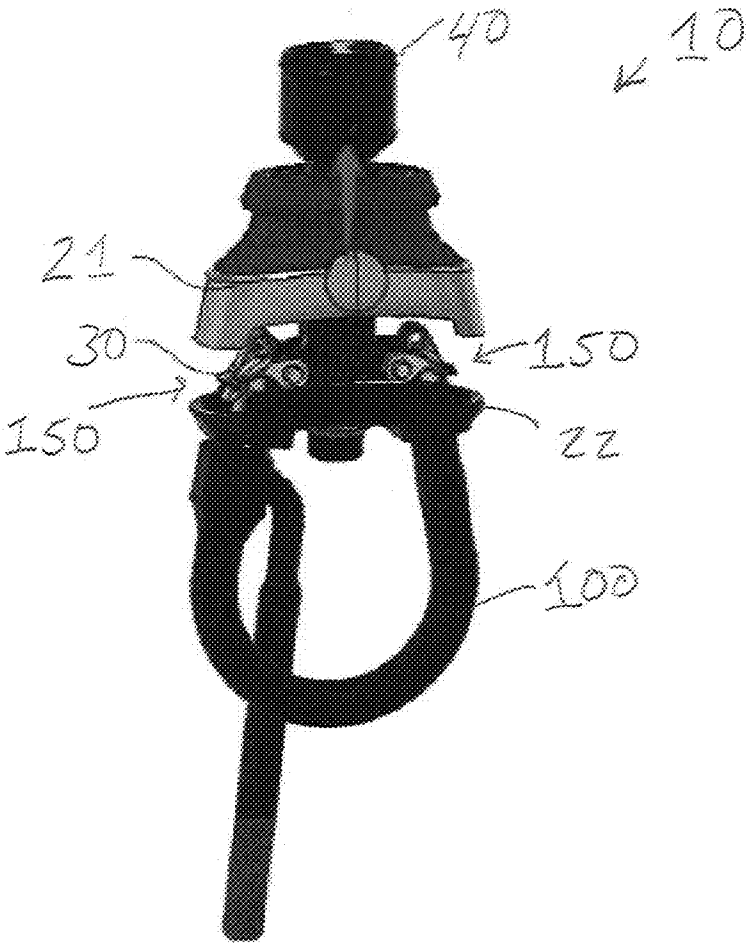
FIG. 4 is a front view of the quick release assembly of FIG. 3 having a slide in an uncovered disposition.
Figure 3:
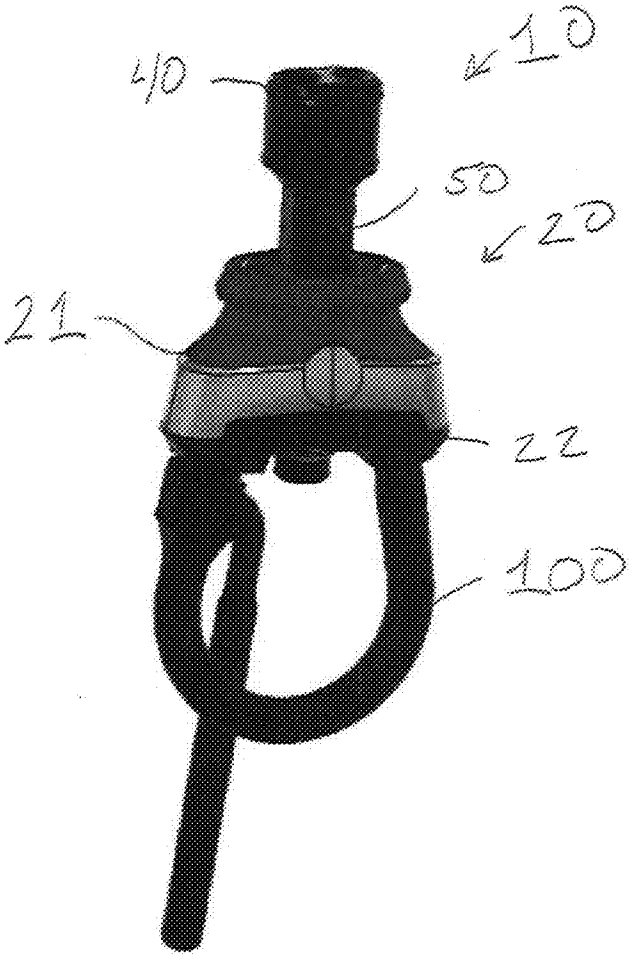
FIG. 3 is a front view of a quick release assembly having a slide in a covering disposition according to one embodiment of the present invention.

FIGS. 3 and 4 provide a detailed view of the quick release loop assembly 10. The primary components of the assembly 10 include a receptacle 40 to receive and channel the static line 200 and landing line tube 300, a shaft 50, a housing 20, a retention mechanism 150, and a loop 100. The housing 20 may include a slide 21 and a base 22. In the preferred embodiment, the retention mechanism is located on the base 22, while the slide 21 acts as the release mechanism for the user. When the user desires to release one end of the loop 100 from the housing 20, the user may grasp the slide 21 and push it toward the receptacle 40, as it is free to slide along the shaft 50. Also in a preferred embodiment, the slide 21 is biased toward the base 22, for example with the use of an elastic cord or band to join the two components together. In any event, the slide 21 is capable of covering the retention mechanism 150 when engaged against the base 22, and is also capable of exposing the retention mechanism 150 when the slide 21 is moved away from the base 22. Accordingly, the slide is capable of transitioning between a covered disposition, as shown in FIG. 3, and an uncovered disposition, as shown in FIG. 4.

Figure 6:
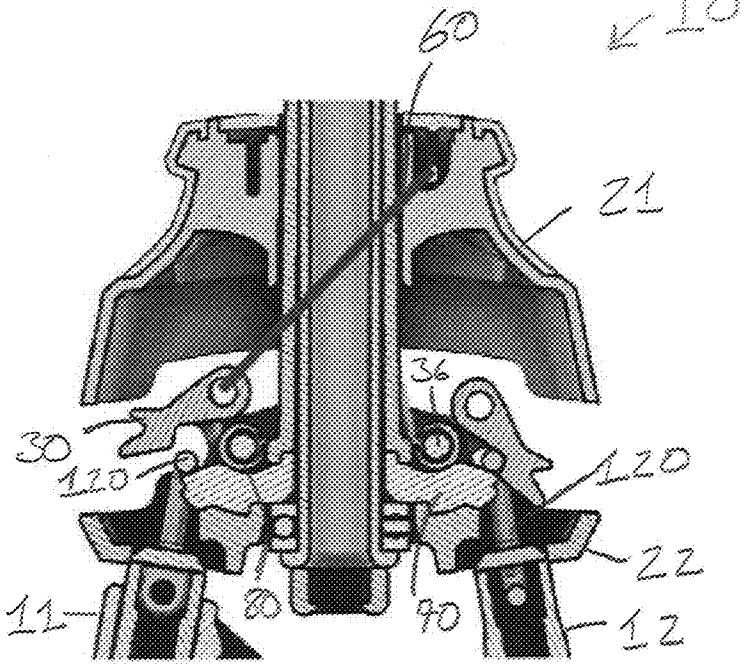
FIG. 6 is a partial section view taken along line A-A of FIG. 1 in which the retention mechanism of the quick release assembly has been released
Figure 5:
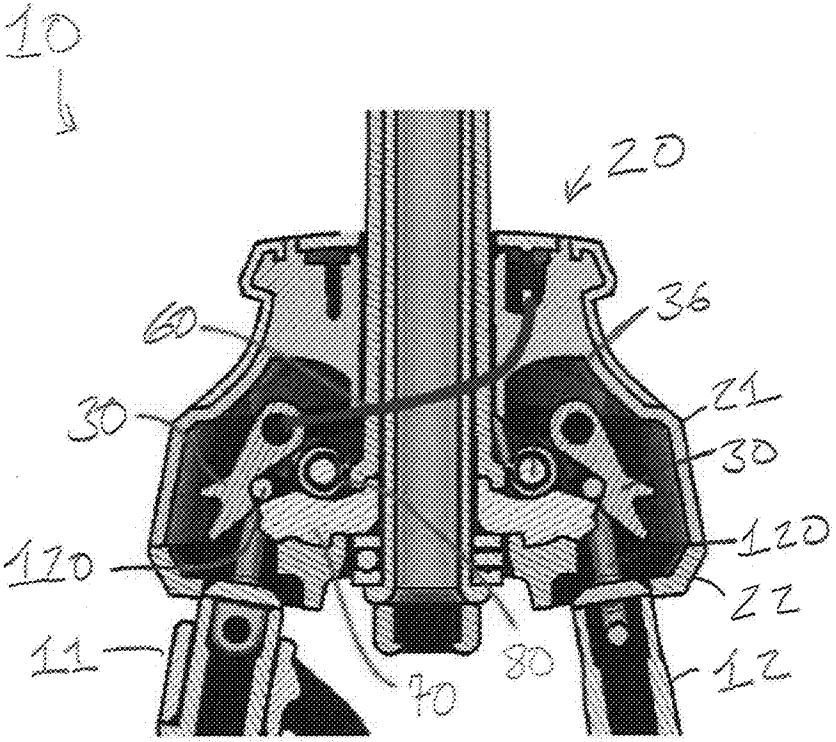
FIG. 5 is a partial section view taken along line A-A of FIG. 1.

FIGS. 5 and 6 present a cutaway view of the quick release loop 10, taken along line A-A of FIG. 1 so that the mechanism of release can be described in more detail. The quick release mechanism 150 includes at least one pawl 30 pivotably attached to the base 22. A torsion spring 80 biases the pawl 30 against a ledge 70. The loop 100 includes a first end 11 and second end 12, each having a retention bar 120 protruding therefrom. In a most preferred embodiment, the pawl 30 and ledge 70 are correspondingly dimensioned and configured to rest against one another at a predetermined angle. It is therefore possible to insert the loop 100 into the quick release loop assembly 10 by pushing the first end 11 or second end 12 into the assembly 10 with sufficient force to cause the retention bar 120 to separate the pawl 20 from the ledge 70. Once fully inserted, the retention bar 120 will rest on the ledge 70 and/or against the pawl 30, but will permit the pawl 30 to close against the ledge 70. This can be considered a retain orientation of the loop 100. In a most preferred embodiment the quick release loop assembly 10 is dimensioned and configured such that, when a force is applied to the loop 10 while the loop 10 is in a retained orientation, all or a substantial portion of the force will be transmitted into the ledge 70, rather than the pawl 30. In such an embodiment, it can be appreciated that it is not possible to remove the retention bar 120 without opening the pawl 30 and allowing the retention bar 120 to slip over the ledge 70.

As can be seen in FIG. 6, in one preferred embodiment, the pawl 30 is pivotably attached at or around its mid-point and the proximal end 32 includes an aperture 34. A line or cable 60 is then attached to the pawl 30 at the proximal end 32 as well as to the slide 21. Upon moving the slide 21 away from the base 22, the line 60 becomes taught and, as force is applied to the slide 21, the line 60 will activate the pawl 30 by overcoming the force of the tension spring 80, thereby permitting the pawl 30 to open and release the retention bar 120. In a most preferred embodiment, the line 60 is attached to the slide 21 on the opposite side from the pawl 30 in order to introduce an oblique angle into the line 60 when the line is taught. This angle, combined with the arrangement of the pawl 30 itself, can provide some mechanical advantage assisting the user in overcoming the force of the retention spring 80.

In the depicted embodiment it can be seen that the quick release loop assembly 10 is mostly symmetrical about the shaft 50, having a pawl 30, ledge 70, and torsion spring combination 80 on both sides of the shaft 50. Additionally, the loop 10 includes retention bars 120 at each of the first end 11 and second end 12. The left half (as depicted) which includes a line 60 connected to the pawl 30 can be considered the quick-release side, as this is the pawl 30 that will release when the slide 21 is moved sufficiently away from the base 22. The right half can then be considered a semi-permanent side because the retention bar 120 on this side will stay connected even when the slide 21 is activated. It is semi-permanent, however, because it is still desirable for the second end 12 of the loop 10 to be released quickly and easily in order to facilitate changes in styles or sizes of loop 10.

Figure 8:
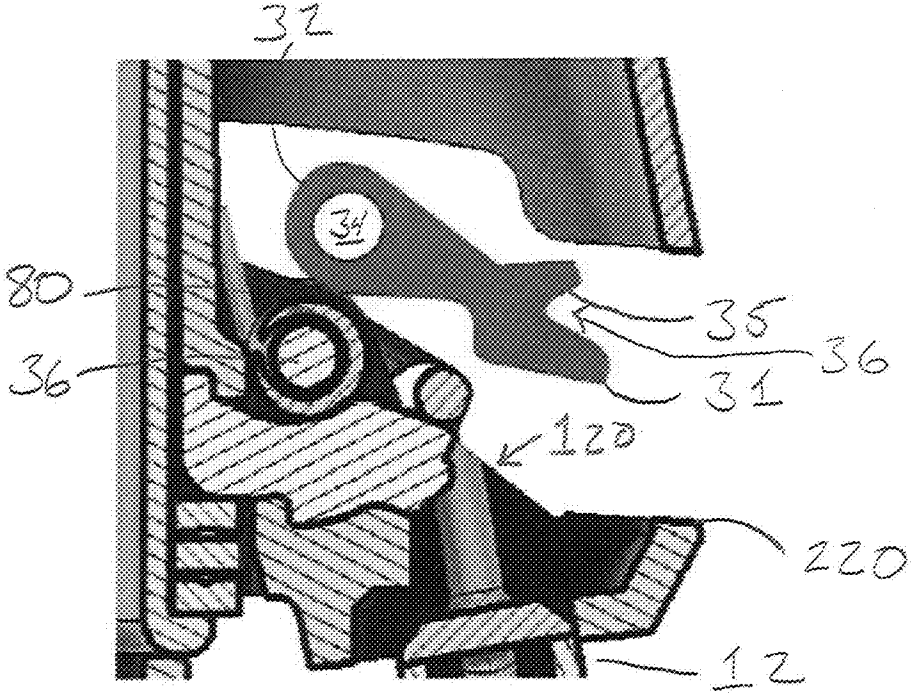
FIG. 8 is a partial section view taken along line A-A of FIG. 1 in which the pawl has been manually lifted.
Figure 7:
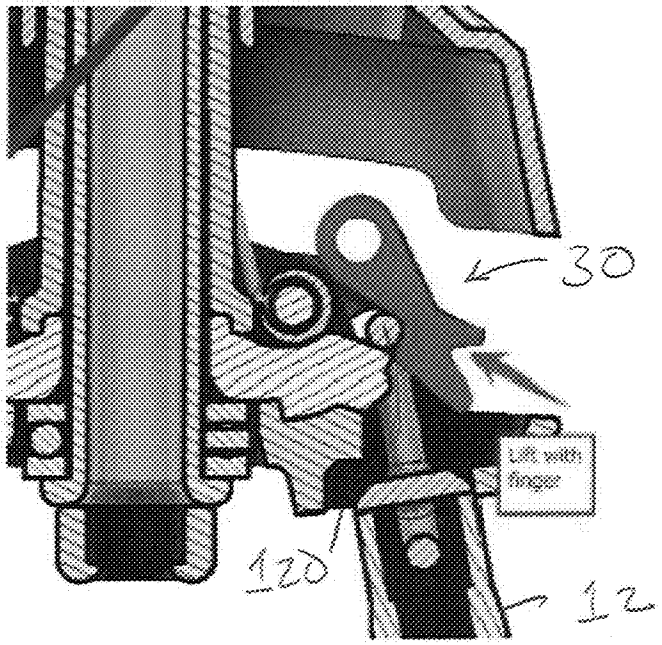
FIG. 7 is a partial section view taken along line A-A of FIG. 1.

Therefore, as can be seen in FIGS. 7 and 8, when the slide 21 is moved into an uncovered disposition, a tab 35 at the distal end 31 of the pawl 30 is exposed. In a preferred embodiment, the force of the torsion spring 80 is selected in combination with the leverage afforded by the tab 31 to permit a user to manually pry open the pawl 30 and release the second end 12 of the loop 10 with his or her fingers. This facilitates a "tool-less" change of loops 100. Alternatively, either end 11, 12 of the loop 10 may be used as a convenient tool to open the pawl 30. An end 11, 12 serves as a more convenient tool than, e.g., a screwdriver or wrench, because typically the loop 10 is only removed when the user desires to change to another style of loop, and so will likely have a second loop handy. In a most preferred embodiment, the tab 35 is correspondingly dimensioned and configured with the distal end 31 of the pawl 30 to create a pry recess 36, which is in turn dimensioned and configured to receive one end 11, 12 of the loop 10. The user may rest the loop 10 against the rim 220 of the base 22 and use it to lever the retention bar 120 into the pry recess 36, thereby opening the pawl 30.

Figure 9:
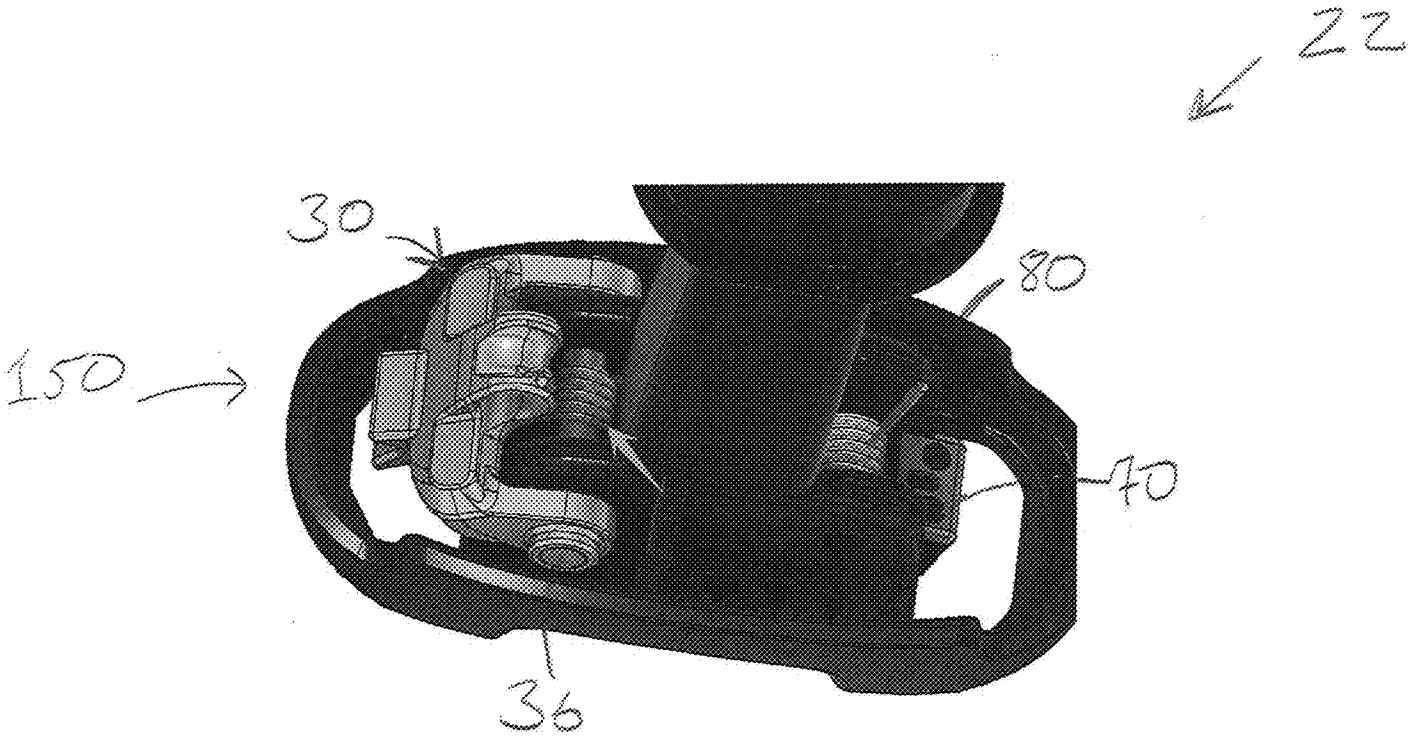
FIG. 9 is a top perspective view of a retention mechanism according to one embodiment of the present invention.

FIG. 9 is a top view of a base 22 having only one pawl 30 installed to further facilitate disclosure of the present invention. In particular, FIG. 9 discloses a preferred embodiment of a pawl 30. As can be seen, the pivot point 35 of the pawl is offset and inboard from the distal end 31. In such an arrangement, it is relatively easy to pivot the pawl 30 when pushing on the distal end 31 from below, such as when the retention bar 120 is being inserted into the retention mechanism 150. However, it takes considerably more force to rotate the pawl 30 when pushing on it at a point above the ledge 70, such as when the retention bar 120 is inserted all the way into a retained orientation. Therefore, it is relatively difficult to withdraw the retention bar 120 without otherwise opening the pawl 30 first.

Figure 10:
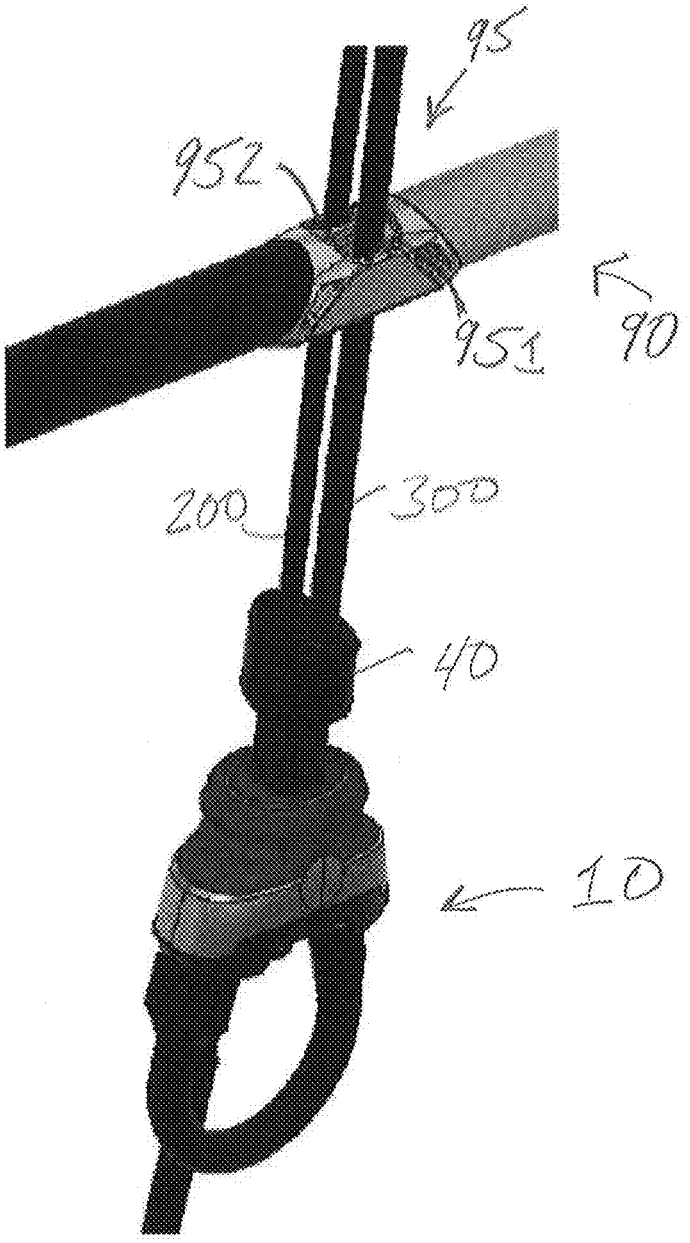
FIG. 10 is a detail view of a control system and quick release assembly according to one embodiment of the present invention.

Turning to FIG. 10, another aspect of the present invention is disclosed. In the depicted embodiment, the static line 200 and the landing line tube 300 pass through the control bar 90 and into retained relation with the receptacle 40. The control bar includes separate indexed chambers 95 for each of the static line 200 and landing line tube 300. This arrangement helps untangle the static line 200 from the landing line tube 300 should they become twisted about one another. This is a common occurrence when a user performs an "unhooked" maneuver. Advanced kite surfers can perform all manner of jumps, twists, and rolls which call for unhooking the loop 10 from the user's harness so that the user is free to rotate relative to kite. One common occurrence, however, is that during one of these maneuvers, the static line 200 and landing line tube 300 can become twisted about one another.

Figure 12:
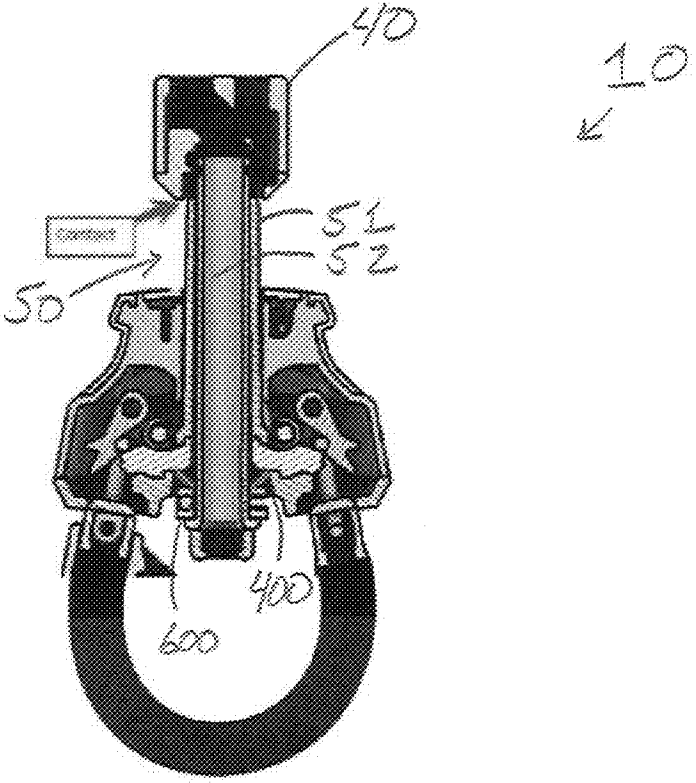
FIG. 12 is a section view taken along line A-A of FIG. 1 in which the loop is unloaded.
Figure 11:
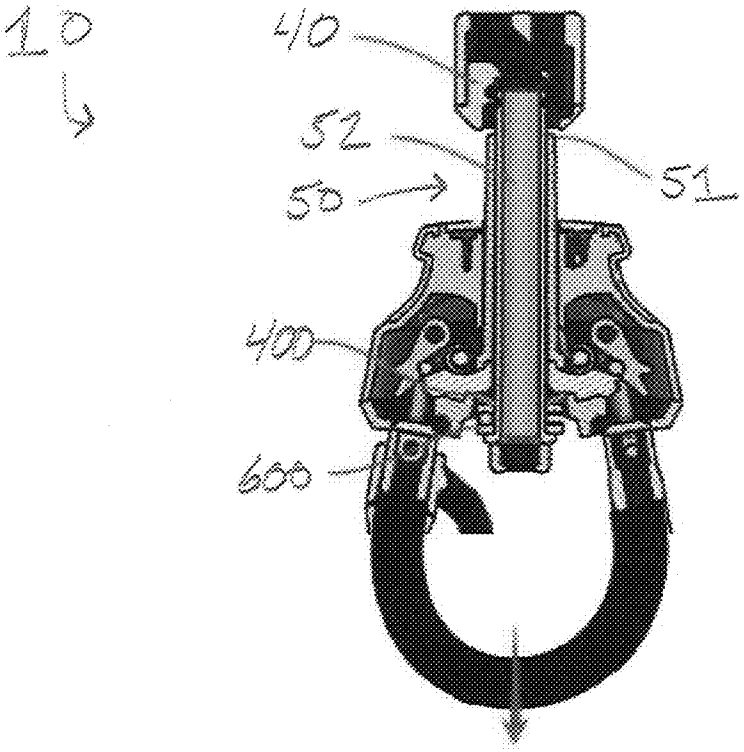
FIG. 11 is a section view taken along line A-A of FIG. 1 in which the loop is loaded.
Figure 13:
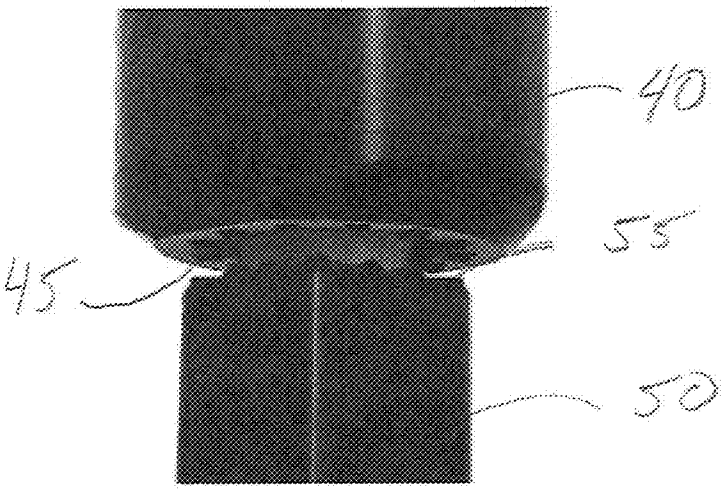
FIG. 13 is a detail view of the interface between a shaft and a receptacle according to an alternative embodiment of the present invention.

With reference now to FIGS. 10, 11, and 12, in a preferred embodiment the shaft is made of a sleeve 51 and inner shaft 52. The sleeve 51 is rigidly attached to the housing 20, while the inner shaft 52 is free to move relative to the sleeve 51. In a most preferred embodiment, the inner shaft 52 can both rotate and translate relative to the sleeve 51. This movable relationship is facilitated by a bearing 600 and spring washer 400 disposed between the bottom end of the inner shaft 52 and the base 22. The spring washer 400 acts to bias the inner shaft 52 downward, toward the loop 10, until the receptacle 40, which is also rigidly attached to the inner shaft 52, comes to rest against the sleeve 51. In such an arrangement, when the loop 10 is loaded with the force of a powered kite pulling a user, it will bias the inner shaft 52 downward, creating a gap between the receptacle 40 and the sleeve 51. Accordingly, the receptacle 40, along with the inner shaft 52, are free to rotate relative to the sleeve 51 and housing 20. Otherwise, when the loop 10 is not loaded, the spring washer 400 will bias the sleeve 51 against the receptacle 40, which will inhibit relative rotation between the sleeve 51 and receptacle 40. As can be seen in FIG. 13, interlocking teeth 45, 55, may be added to the surfaces where the sleeve 51 and receptacle 40 interface to help ensure they are locked together when the assembly is unloaded.

Now that those relationships have been described, their function as an automatic swiveling assembly can be appreciated. More specifically, upon initiating an unhooked maneuver the user will first unhook the loop 10 from his or her harness. This will unload the loop 10, causing the spring washer 400 to force the sleeve 51 against the receptacle 40. In this arrangement the entire assembly will rotate as one unit. This behavior will maintain the loop in the same orientation throughout the whole maneuver, which is an important attribute that allows the rider to quickly re-hook without having to check or adjust the orientation of the loop. However, because the rider may have rotated the control bar 90 during the maneuver, it is possible that the static line 200 and landing line tube 300 will twist about one another, causing a safety hazard. Accordingly, once the user re-hooks and the loop 10 is loaded again, the receptacle 40 will separate from the sleeve 51 and the receptacle will be free to rotate independently of the loop 10. The static line 200 and landing line tube 300 will naturally tend to unravel if no force is holding them together, so the arrangement permits an automatic swiveling when the loop is under load. Otherwise, the user can pull on the control bar 90 and allow the separate indexed chambers 951, 952 to unwind the two lines.

FIG. 13 is a detail view of an alternative embodiment in which the shaft 50 and receptacle 40 include mating teeth 45, 55 on their respective interface surfaces. The teeth 45, 55 provide mechanical grip between the shaft 50 and receptacle 40 to help ensure that they rotate as one unit when the loop 10 is unloaded.

Figure 14:
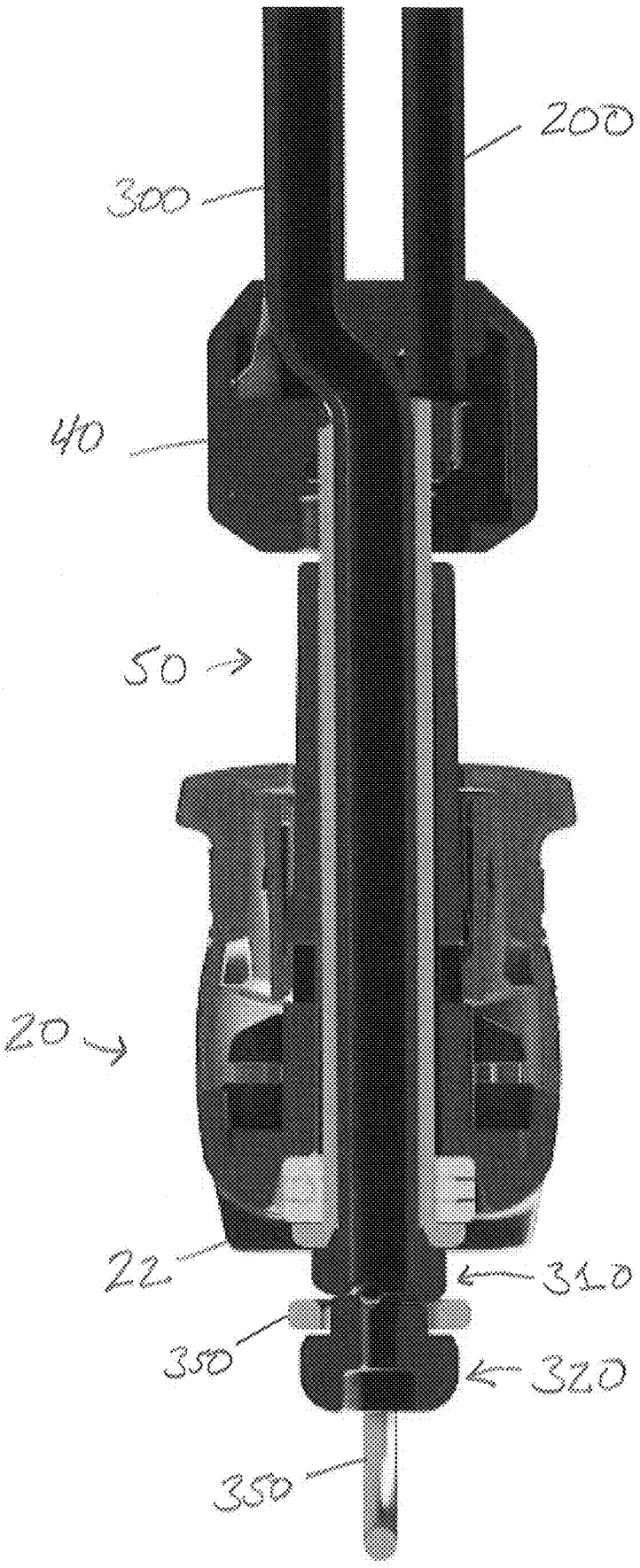
FIG. 14 is a section view taken along line B-B of FIG. 1.
Figure 15:
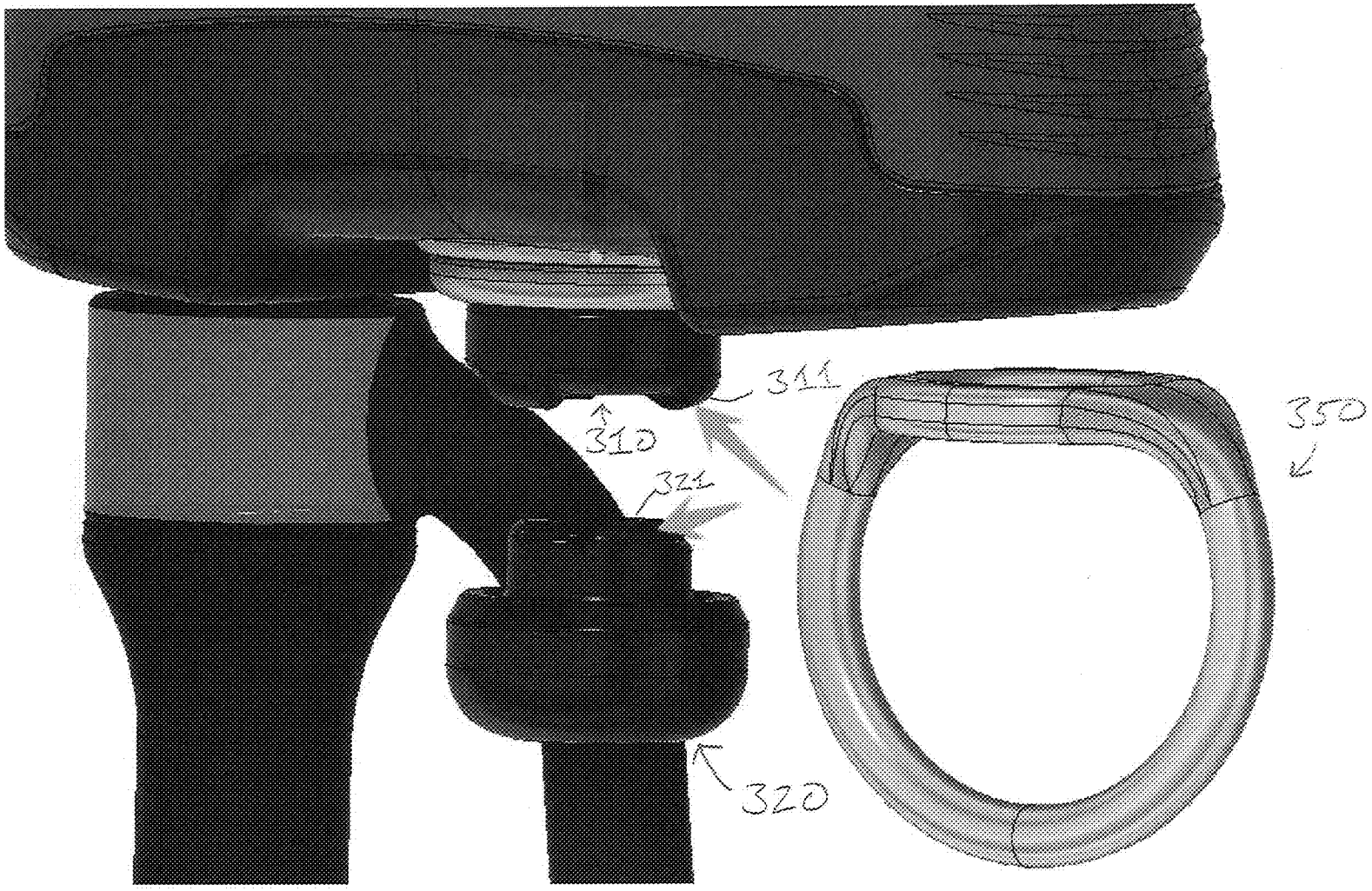
FIG. 15 is a detail view of a collar and stopper according to one embodiment of the present invention.

FIG. 14 is a section view taken along line B-B of FIG. 2. As can be seen, the landing line tube 300 travels through the receptacle 40, shaft 50, and housing 20, exiting below the base 22 of the housing. The landing line itself (not picture) is secured to a leash stopper 320 that interfaces against the bottom collar 310 of the landing line tube 300. A ring 350 also floats between the leash stopper 320 and collar 310 which serves as an attachment point for a safety leash that connects to the user's harness. With reference now to FIGS. 14 and 15, it can be seen that teeth 311, 321 are disposed on the interfacing surfaces of the collar 310 and stopper 320. This arrangement helps ensure that the landing line indexes along with the quick release assembly 10 and the kite itself. Otherwise, if the landing line becomes twisted inside of the landing line tube 300, it can cause safety issues.

Figure 16:
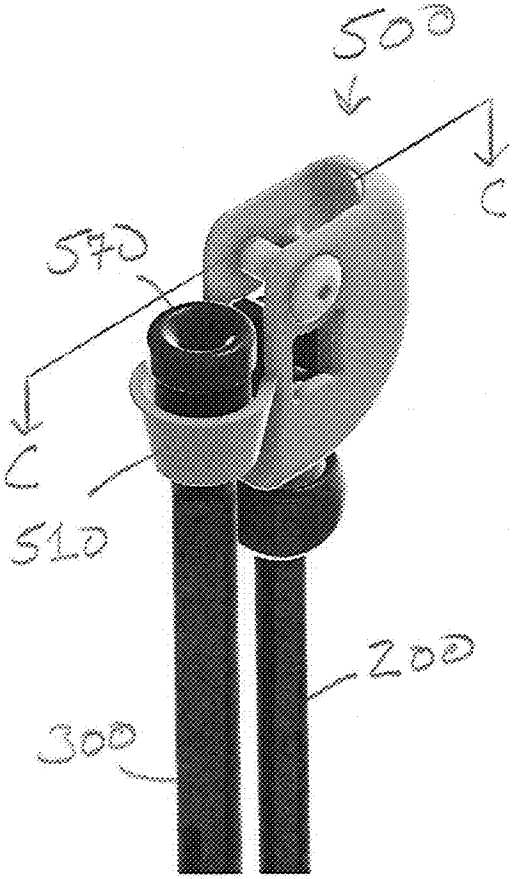
FIG. 16 is a perspective view of a trim cleat according to one embodiment of the present invention.
Figure 14:
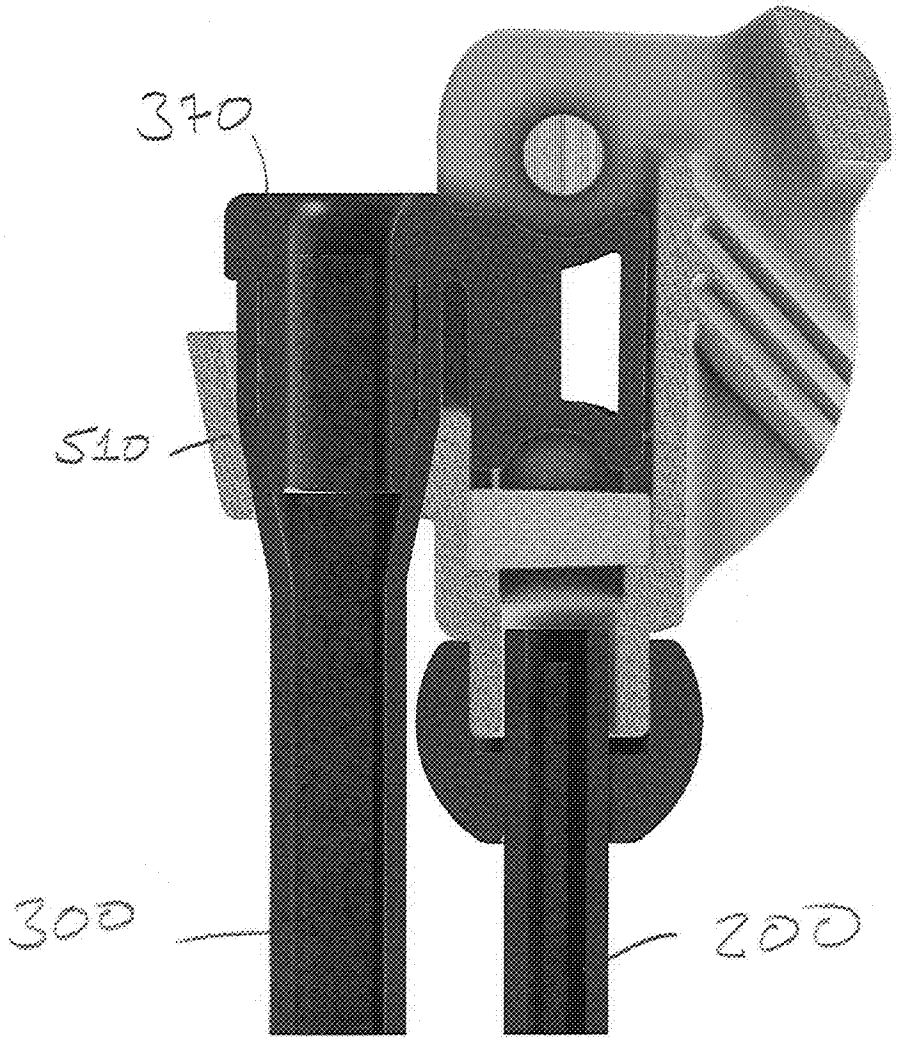

FIGS. 16 and 17 depict a trim cleat assembly 500 in accordance with one embodiment of the invention. In particular, FIG. 17 is a section view taken along line C-C of FIG. 16. The trim cleat 500 serves to connect the static line 200 to other rigging lines that run toward the kite and can be used to trim the kite. As can be seen, the trim cleat 500 can include a cup 510 having a substantially funnel or wedge-shaped sidewall which supports the landing line tube 300. A barbed insert 370 is inserted in the top of the landing line tube 300 and the entire assembly is seated within the cup 510. As such, the landing line tube 300 becomes wedged and secured in place between the barbed insert 370 and the cup 510. This arrangement allows for the landing line tube 300 to be easily removable for service or replacement, as no adhesive or other more permanent installation methods are required.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A trim cleat for a water sports control system comprising:

a cup having a wedge-shaped inner surface configured to receive a landing line tube therein;

a barbed insert configured to be inserted inside said landing line tube;

said barbed insert being cooperatively structured and configured with said cup to wedge and releasably secure said landing line tube inside said cup.

* * * * *